United States Patent [19]

Drugge

[11] 4,316,718

[45] Feb. 23, 1982

[54] HEATING OR HEAT-TREATMENT PLANT

[75] Inventor: Roland Drugge, Malmberget, Sweden

[73] Assignee: Luossavaara - Kiirunavaara Aktiebolag, Stockholm, Sweden

[21] Appl. No.: 184,158

[22] Filed: Jun. 4, 1980

[30] Foreign Application Priority Data

Sep. 6, 1979 [SE] Sweden ..... 7907419

[51] Int. Cl.[3] ..... F27B 15/00

[52] U.S. Cl. ..... 432/58; 308/1 R; 432/137

[58] Field of Search ..... 432/58, 137; 308/1 R, 308/DIG. 1

[56] References Cited

U.S. PATENT DOCUMENTS

| | | | |
|---|---|---|---|
| 756,600 | 4/1904 | Dodge | 308/DIG. 1 |
| 3,184,224 | 5/1965 | Shelley | 432/58 |
| 3,947,001 | 3/1976 | Leighton | 432/137 |

FOREIGN PATENT DOCUMENTS

| | | |
|---|---|---|
| 362854 | of 0000 | Sweden . |
| 1205621 | 11/1967 | United Kingdom . |

*Primary Examiner*—John J. Camby

*Attorney, Agent, or Firm*—Fleit & Jacobson

[57] ABSTRACT

In a plant for heating or heat-treating a bed of material carried by an upper part of an endless, perforated belt-type conveyor, said upper part extending through at least one heating or heat-treatment zone in which heating or heat-treatment gas passes through said upper part and the bed being conveyed thereon, the conveyor includes a plurality of mutually adjacent endless, imperforate belt parts. These belt parts are separated by perforated regions. The upper conveyor part is slidably supported, preferably by means of gas-cushion bearings, along at least substantially the whole of its material-carrying length in the region of said belt parts.

8 Claims, 7 Drawing Figures

HEATING OR HEAT-TREATMENT PLANT

The present invention relates to a plant for heating or heat-treating a bed of material carried by an upper part of an endless, perforated belt-type conveyor, said upper part extending through at least one heating or heat-treatment zone in which heating or heat-treatment gas passes through said upper part and the bed being conveyed thereon and through an optional further layer of gas-permeable material located between said upper part and said bed.

In plants of the aforementioned kind when heating heavy beds of lump material to high temperatures, e.g. when sintering pellets of ore concentrate, very heavy and complicated conveyor constructions are used, said constructions comprising substantially self-supporting units, such as grate carriages and the like, whereat in practice the weight of the movable conveyor part is at least of the same order of magnitude as that of the material being conveyed, and the costs of the plant per quantity of material which can be heated or heat-treated per unit of time are very high. Heating or heat-treatment plants having conveyors in the form of endless perforated belts of relatively low weight are also known to the art. Hitherto known conveyor-belt constructions, however, can only be used when heating to very modest temperatures, e.g. temperatures of up to about 300° C., such as in drying plants and the like, whereat material, which can generate dust with abrasive properties cannot be treated when using known perforated belt constructions with associated supporting devices.

The object of the present invention is to provide a novel and advantageous arrangement, whereby the aforementioned disadvantages are at least substantially eliminated.

To this end there is proposed a plant of the kind mentioned in the introduction in which the conveyor includes a plurality of mutually adjacent endless, imperforate belt parts separated by perforated regions, whereat the upper conveyor part is slideably supported along at least substantially the whole of its material-carrying length in the region of said imperforate belt parts by bearings which act on the undersurface of respective imperforate belt parts and which are completely covered by said belt parts. In this way the advantage is afforded whereby a large supporting bearing-surface can be obtained for the upper conveyor part, while avoiding in a simple manner entry of abrasive dust between said belt parts and the upper conveyor-part carrying means acting against said belt parts.

Conveniently, the bearings supporting said imperforate belt parts are pressure fluid bearings, preferably gas-cushion bearings, it being possible to give said fluid a flow pattern such that abrasive dust is flushed away from the supporting regions.

The perforations in the conveyor are formed by slots which preferably extend in the transverse direction of the conveyor, whereby differences in longitudinal expansion of the perforated regions and of the imperforate belt parts in the longitudinal direction of the conveyor can be compensated by spontaneous change of the width of the slots, so that buckling or other forms of deformation of the imperforate belt parts is at least substantially avoided, while expansion of the upper conveyor part in its cross-direction can be permitted to lead to a certain amount of sagging of the perforated regions between the supported imperforate regions.

According to a particularly simple, and therefore preferred embodiment of the invention the conveyor comprises a single endless metal belt provided in the regions between the imperforate belt parts, rows of sequentially arranged slots which extend in the transverse direction of the conveyor, whereat the slots in adjacent rows are so displaced relative to one another that the regions between the slots in one row are located opposite the slots of adjacent rows of slots, and whereat the length of the slots in each row and the mutual spacing of said slots in said row and the distance between the slots in adjacent rows are so adjusted that the slotted regions of the belt are springy in the longitudinal direction of the conveyor, for compensating differing longitudinal expansion of the regions perforated with said slots and the imperforate, supported belt parts.

According to another advantageous embodiment of the invention, said belt parts comprise a plurality of separate endless belts arranged side by side, said belts being provided with holders mounted along the length thereof for a plurality of rails extending transversely of the longitudinal direction of the belts, whereat the perforations are formed by the spacing between adjacent rails This arrangement facilitates manufacture of the conveyor and enables worn conveyor parts to be readily exchanged. Thermal expansion of the conveyor in its transverse direction can be readily compensated for in this construction, by arranging for the rails to be displaceable relative to the holders in the cross-direction of said conveyor, whereat each of said belts is individually guided in the lateral direction.

When the heating or heat-treatment plant includes a plurality of heating or heat-treatment zones arranged along the length of said plant, whereat the flow direction of the heating or heat-treatment gas and/or the rate of flow of said gas differs in respective zones, as is normally the case in band sintering plants, the upper conveyor part is subjected to different loads. When using gas-cushion bearings the correct lifting force on the conveyor part in the different zones can readily be obtained by arranging, for supporting the imperforate belt parts, gas-cushion bearings with individually adjustable gas-cushion pressures, said gas-cushion bearings being separated from each other in the border region between said zones.

A number of exemplary embodiments of the invention will now be described with reference to the accompanying drawing.

Figure 1:
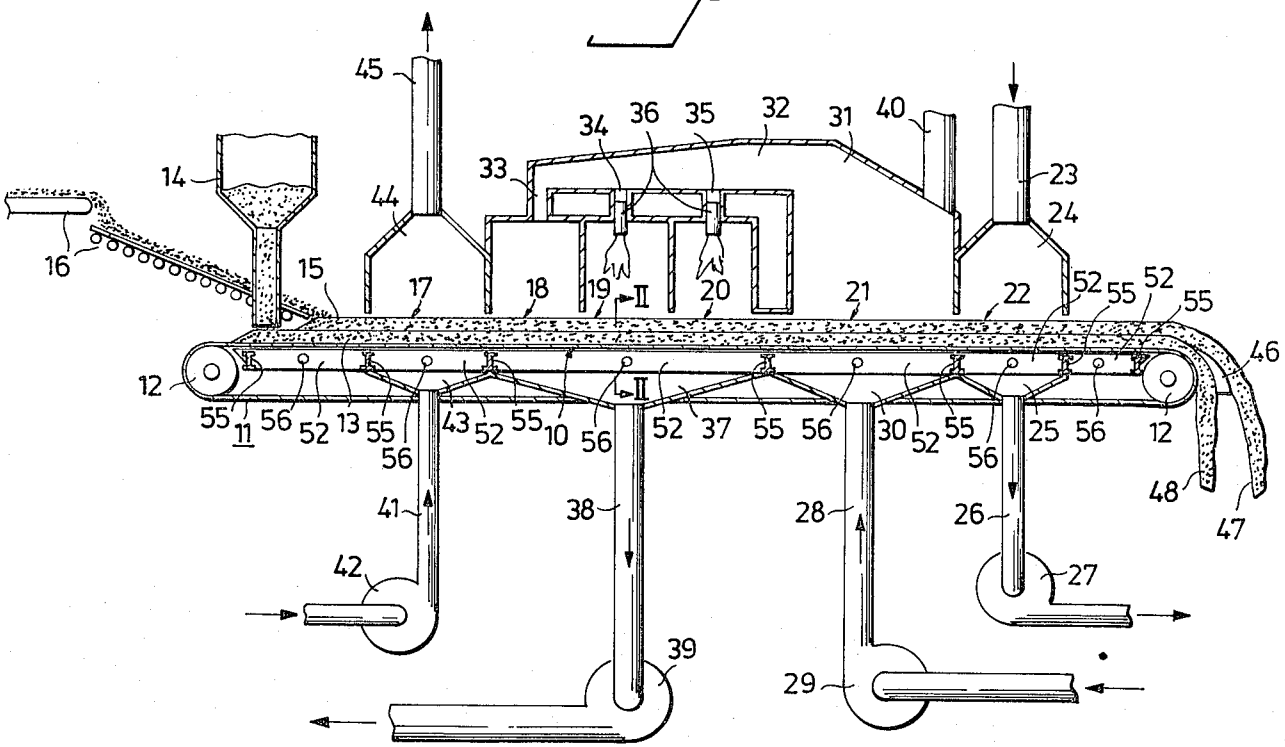
FIG. 1 illustrates schematically a belt-sintering plant having an arrangement according to the present invention.
Figure 2:
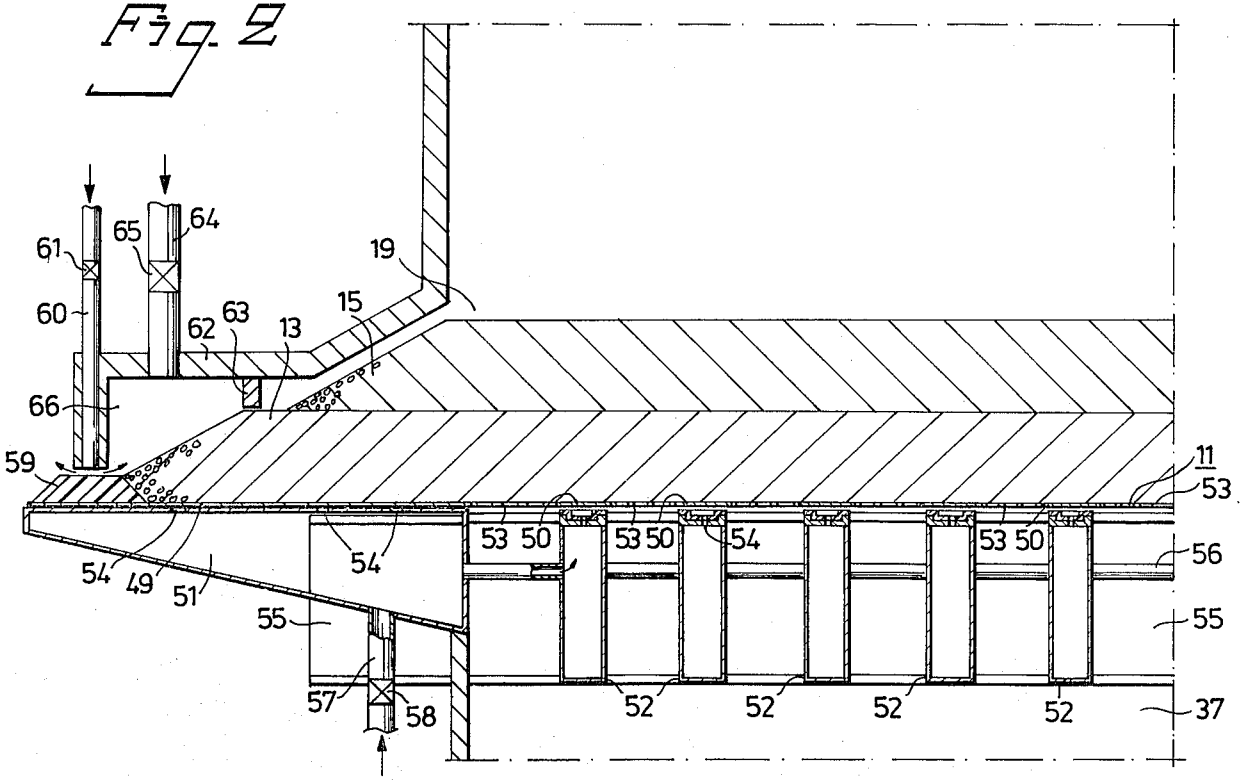
FIG. 2 is a sectional view in larger scale of said plant, substantially taken on the line II—II in FIG. 1.

The pellet sintering plant illustrated in FIGS. 1 and 2 includes a movable grate 10 which is shielded against the surrounding atmosphere and which is formed by the upper horizontal part of an endless, gas-permeable belt 11 which passes around driven rollers 12. To the infeed part of the grate 10 there is fed a hearth layer 13 of hot, durable pellets from a bunker 14, and an upper layer 15 of agglomerated material in the form of moist, pelletized green pellets or raw pellets which are to be fired in the plant, said raw pellets being fed to the grate 10 by means of conveyor means 16. The grate transports the bed comprising said layers of pellets through pre-drying and final-drying zones 17, 18, pre-heating and final-heating zones 19, 20 and pre-cooling and final-cooling zones 21, 22. The raw pellets are pre-dried in the pre-drying zone 17 and the pellet bed is cooled in the cooling zone 21 by means of a gas which passes upwardly through the grate 10 and the pellet bed, while said bed is pre-heated and finally heated in the pre-heating and final-heating zones 19, 20, respectively, for firing dried pellets, by means of a gas which passes downwardly through said pellet bed and the grate. A gas which flows downwardly through the grate and the pellet bed is also used in the final-cooling zone 22. The final-cooling gas is cool air which is passed, through a line 23, to a pressure chamber 24 located above the grate 10, adjacent the outfeed end thereof. Arranged on the side of the grate opposite the pressure chamber 24 is a collecting chamber 25 for collecting air used in the final-cooling stage. The heated, but relatively substantially pure air used for the final-cooling stage is led away via a line 26 and a fan 27.

The pre-cooling gas, for example substantially cool air, is supplied, via a line 28 and a fan 29, to a pressure chamber 30 located beneath the grate 10, from which chamber the gas passes upwardly through the grate and the bed into a collecting chamber 31. The major part of the air which has been used for pre-cooling purposes passes from said collecting chamber through a main line 32 and branch lines 33-35, to the final-drying zone 18 and to the pre-heating and final-heating zones 19, 20, where it is utilized as drying air and as secondary air of cumbustion for burners 36 which are arranged above the pellet bed and which generate hot cumbustion gases intended for the pre-heating and final-heating stages. The final-drying zone 18 and the pre-heating and final-heating zones 19, 20 are separated from each other above the grate 10 and from the pre-drying and pre-cooling zones 18, 21, by means of depending walls. Arranged beneath the grate 10 is a suction chamber 37 for collecting the gases arriving from the zones 18, 19, 20 subsequent to the passage of said gases through the grate and the bed. The suction chamber 37 is connected, via a line 38, to the suction side of a fan 39, which conveys the collected gas to a gas-purifying plant not shown. Any surplus gas in the chamber 31 is carried away through a line 40.

Pre-drying of the pellets is effected with atmospheric air, which is passed to a pressure chamber 43 located beneath the grate 10, via a line 41 and a fan 42. The air passes from said chamber 43 through the grate 10, whereat said air cools the grate and is then heated by the hot hearth material, whereafter said air continues to pass up through the bed, while pre-drying the moist pellets forming the layer 15. The pre-drying air is collected in a suction chamber 44 and is passed therefrom, for example, to a chimney, via a line 45. Alternatively, at least a part of the final-cooling air can be used for pre-drying purposes.

Arranged at the outfeed end of the grate 10 is a separating device 46 which in the illustrated embodiment has the form of a blade, which extends transversely of the grate and which is so positioned in relation to the surface of the grate that it divides the bed into a layer 47 comprising solely sintered product pellets originating from the pellet layer 15, and a layer 48 which comprises substantially solely material originating from the hearth layer 13. The layers 47 and 48 are each passed to a respective conveyor (not shown) for transport to a product-pellet storage site and for transport, while still hot, back to the bunker 14, for use as hearth-layer material.

Figure 3:
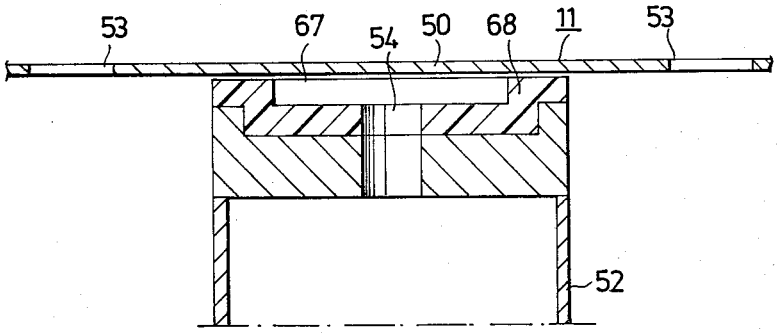
FIG. 3 is a cross-sectional view of an upper part of one of the box beams by which the upper conveyor part is supported by gas cushions.
Figure 4:
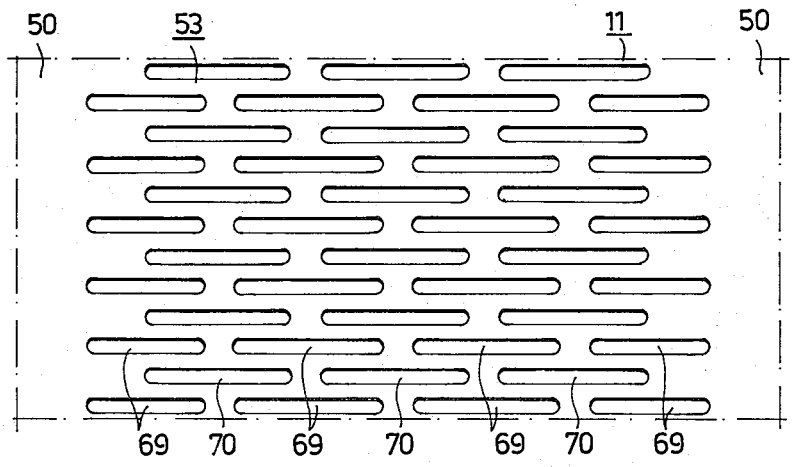
FIG. 4 is a plan view of a part of the conveyor belt used in the plant according to FIGS. 1–3.

As will be seen more clearly from FIGS. 2–4, the conveyor 11 comprises a relatively thin endless belt, which may be made of steel. The belt 11 has a plurality of mutually adjacent endless, imperforate belt parts 49, 50 which are situated over support means 51, 52 and which are separated by perforated endless regions or areas 53. The support means comprise gas-cushion bearings having the form of box beams having outlet openings 54 for air or some other gas, arranged at the top thereof. Each box beam 51 or 52 is divided along its length by means of transversely extending beams 55 (FIG. 1) which carry said box beam 51 or 52, to form a plurality of gas-cushion bearings sequentially in the longitudinal direction of the grate 10, whereat groups of mutually adjacent gas-cushion bearings arranged between adjacent beams 55 are provided with means for individually setting the gas-cushion pressure. In the illustrated embodiment the box beams 51, 52 in each group of gas cushion bearings are supplied from individual gas-supply lines 56, 57, whereat valve means may be arranged, as shown at 58 in FIG. 2, for individually setting the gas-cushion pressure for each group of gas-cushion bearings.

As will also be seen from FIG. 2, the imperforate belt part 49 located by the side of the grate 10 has considerably greater width than the remaining imperforate belt parts 50. The belt parts 49 are arranged in laterally projecting housing structures along the sides of the sintering plant. Along each side of the belt 11 there is arranged a longitudinally extending bead 59 which is formed by a glued profile of elastomeric material, which forms a retaining element for the hearth layer 13 and which may be cooled in a controllable manner, as indicated through the line 60 and the valve 61 in FIG. 2. A longitudinally extending partition wall 63 extends downwardly from the upper wall 62 of said housing structure to the upper surface of the hearth layer 13, whereat gas under pressure can be supplied to the region 66 of said housing structure located outside the wall 63, via line 64 and the valve 65.

The upper part of a box beam 52 is shown in more detail in FIG. 3. As will be seen, the box beam is provided on its upper side with a channel 67 or a plurality of sequentially arranged recesses, into which at least one gas outlet 54 discharges. Said upper side may, to advantage, be coated with a material having good sliding properties, for example a heat-durable plastics having a low coefficient of friction, as indicated at 68.

FIG. 4 illustrates a pattern of perforations which can be used to advantage when the conveyor belt 11 has the form of a single endless belt made, for example, of steel. In this case the perforations comprise rows of slots 69, 70 extending in the cross-direction of the belt 11, whereat the slots 70 in one row thereof overlap the regions between sequential slots 69 of adjacent rows. Further, the length of the slots 69 or 70 in each row and the distance between said slots, and the distance between the slots 69, 70 in adjacent rows can be so adapted that the slotted region 53 is gently sprung in the longitudinal direction of the belt 11, in a manner such that differing expansions in the length of the belt 11 in the region 53 and flanking areas 50 do not cause buckling or deformation of the belt parts 50, but cause instead minor changes in the width of the slots 69, 70.

Figure 5:
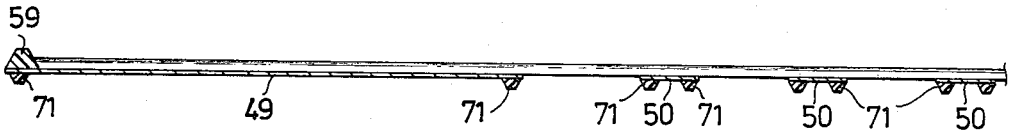
FIG. 5 is a part cross-sectional view of a further belt-type conveyor, which can be used in conjunction with the arrangement according to the invention.
Figure 6:
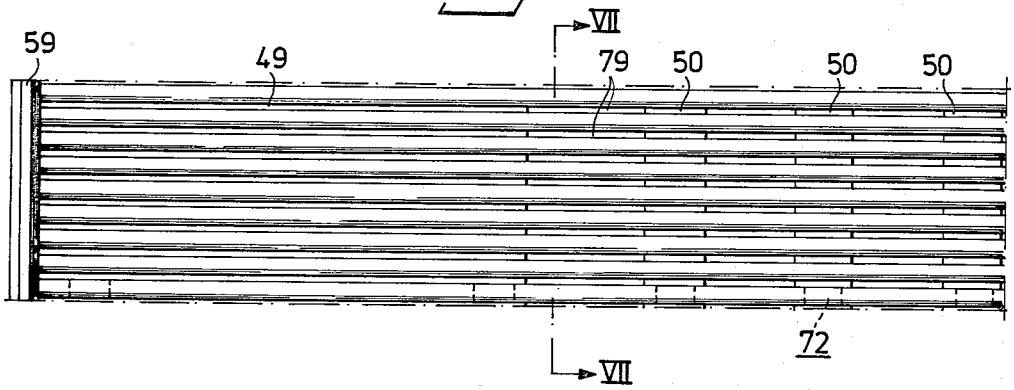
FIG. 6 is a plan view of a part of the conveyor according to FIG. 5.
Figure 7:
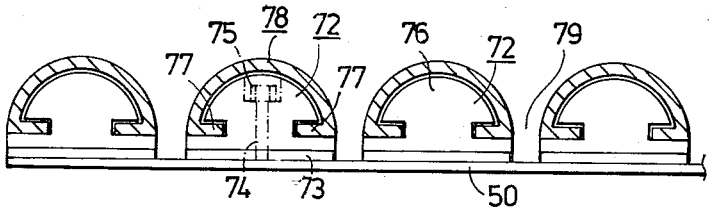
FIG. 7 is a sectional view of a part of the conveyor taken on the line VII—VII in FIG. 6.

FIGS. 5–7 illustrate an advantageous alternative embodiment of the conveyor 11, in which the imperforate belt parts 49, 50 are formed of mutually adjacent endless individual belts made, for example, of steel. The belts 49, 50 are provided on the underside thereof with pairs of longitudinally extending guide bars 71 made of a resilient material and arranged to be placed on a respective side of an associated box beam (51, 52 in FIG. 2). The belts 49, 50 are provided in the manner illustrated in FIG. 7 with holders 72 which are joined to the belt surface via intermediate elements 73 of a resilient, heat-durable material. For example, as indicated with chain lines in FIG. 7, the belts 49, 50 may carry screw-threaded bolts 74 which are fixed by spot-welding and over which said elements 73 and holders 72 are fitted and thereafter secured with a nut 75.

The holders 72 are each provided with a heat 76, beneath which are arranged grooves which extend transversely of the belt 49 or belt 50 and which accommodate longitudinally displaceable, inwardly extending flanges 77 on profiled rails 78 having a substantially semi-circular upper surface, when seen in cross-section. The rails 78 are spaced apart in a manner such as to obtain in the regions between the belts 49, 50 slot-like openings 79 for passage of the heating or heat-treatment gas through the upper part of the conveyor 11.

In the aforegoing the invention has been described with reference to a sintering plant, because particularly important advantages can be achieved in this connection. The invention, however, is neither restricted to this use nor to the embodiments illustrated in the drawing, but can be modified within the scope of the following claims.

What I claim is:

1. An arrangement in a plant comprising and endless, perforated belt-type conveyor, means forming heating or heat-treatment zones for a bed of material carried by an upper part of said endless, perforated belt-type conveyor, said upper conveyor part extending through at least one said heating or heat-treatment zone in which heating or heat-treatment gas passes through said upper conveyor part and the bed of material being conveyed thereon and through an optional further layer of gas-permeable material located between said upper conveyor part and said bed, the conveyor including a plurality of mutually-adjacent endless, imperforate belt parts separated by perforated regions, bearing means for said conveyor, the upper conveyor part being slidably supported along at least substantially the whole of its material-carrying length in the region of said imperforate belt parts by said bearing means which act on the under surface of respective imperforate belt parts and which are completely covered by said belt parts.

2. An arrangement according to claim 1, wherein said bearing means are pressure-fluid bearings.

3. An arrangement according to claim 2, wherein said pressure-fluid bearings are gas-cushion bearings.

4. An arrangement according to any one of claims 1, wherein the perforations are formed by slots which extend substantially in the transverse direction of the conveyor.

5. An arrangement according to claim 4, wherein the conveyor comprises a single endless metal belt having in regions between the imperforate belt parts rows of sequentially arranged slots which extend transversally of the conveyor, the slots in adjacent rows being so displaced relative to one another that the regions between the slots in one row are located opposite slots in adjacent rows of slots; and the length of the slots in each row and the mutual spacing of said slots in said row and the distance between the slots in adjacent rows being such that the slotted regions of the belt are resilient in the longitudinal direction of the conveyor, for compensating for differing longitudinal expansion of the regions perforated with said slots and the imperforate, supported belt parts.

6. An arrangement according to claim 1 wherein said belt parts comprise a plurality of separate endless belts arranged side-by-side, said belts including holder means mounted along the length thereof, a plurality of rails engaged by said holder means and extending transversally of the longitudinal direction of the belts, said perforations being formed by the spacing between adjacent rails.

7. An arrangement according to claim 6, wherein the rails are displaceable relative to the holders in the cross-direction of the conveyor, whereat each of said belts is individually guided in the lateral direction.

8. An arrangement according to claim 3 wherein the plant includes a plurality of said heating or heat-treatment zones arranged along the length of said plant, the flow direction of the heating or heat-treatment gas and/or the rate of flow of said gas differing in respective zones requiring a corresponding difference in the pressure of said bearing means, said bearing means comprising gas-cushion bearings, each of said imperforate belt parts being supported by a plurality of said gas-cushion bearings separated from each other in a border region between said zones.

* * * * *